United States Patent [19]

Long et al.

[11] 4,299,281

[45] Nov. 10, 1981

[54] COMPENSATING BRIDGE PLUG

[75] Inventors: Olen R. Long, Celina; Ronald F. Langham, Carrollton, both of Tex.

[73] Assignee: Otis Engineering Corporation, Dallas, Tex.

[21] Appl. No.: 40,518

[22] Filed: May 21, 1979

[51] Int. Cl.[3] ..... E21B 33/129

[52] U.S. Cl. ..... 166/135; 166/156; 166/313

[58] Field of Search ..... 166/135, 192, 153, 156, 166/189, 313, 319, 316

[56] References Cited

U.S. PATENT DOCUMENTS

| | | | |
|---|---|---|---|
| 2,888,080 | 5/1959 | Tausch et al. | 166/192 |
| 2,970,648 | 2/1961 | Daffin et al. | 166/189 |
| 3,002,563 | 10/1961 | Crowe | 166/135 |
| 3,029,872 | 4/1962 | Hanes | 166/135 |
| 3,381,753 | 5/1968 | Fredd | 166/189 |
| 3,448,803 | 6/1969 | Sizer | 166/319 |
| 3,664,427 | 5/1972 | Deaton | 166/319 |
| 3,680,637 | 8/1972 | Raulins | 166/316 |
| 3,739,850 | 6/1973 | Sizer | 166/313 |

*Primary Examiner*—James A. Leppink
*Attorney, Agent, or Firm*—Thomas R. Felger

[57] ABSTRACT

A well tool or bridge plug for blocking fluid communication through well tubing. The present invention allows a fixed volume of liquid to be trapped within the well tubing while installing the plug. A piston means is releasably secured within the bridge plug. The piston means can slide relative to the housing of the bridge plug to compensate for any liquid displaced by inserting the bridge plug into the well tubing. The present invention is particularly adapted for use in through the flow line (TFL) or pumpdown well completions. However, the present invention could be used with wireline equipment.

7 Claims, 5 Drawing Figures

COMPENSATING BRIDGE PLUG

BACKGROUND OF THE INVENTION

1. Field of the Invention

The present invention is a well tool for plugging or bridging the bore of a well tubing string. The bridging tool can be secured at preselected locations within the tubing string.

2. Prior Art

Through the flowline (TFL) or pumpdown well servicing equipment is frequently used for maintenance of offshore wells. TLF requires two flowlines, operated in conjunction with each other, to move a tool string from the well surface to a downhole location. The tool string is slidably disposed in one flowline and fluid, displaced by the tool string movement, is communicated in the other flowline. A cross-over conduit or H-member is generally located downhole to allow fluid communication between the two flowlines.

U.S. Pat. No. 3,448,803 and U.S. Pat. No. 3,739,850 both to Phillip S. Sizer disclose various types of H-members or cross-over assemblies satisfactory for use with the present invention. U.S. Pat. No. 3,680,637 to George Max Raulins and U.S. Pat. No. 3,664,427 to Thomas M. Deaton disclose various H-members and well tools or bridge plugs for blocking fluid flow through one leg of the H-member.

SUMMARY OF THE INVENTION

The present invention discloses a well tool for blocking fluid communication through a tubing string, comprising: a housing with a longitudinal bore therethrough; means, carried on the exterior of the housing, for forming a fluid tight seal between the exterior of the housing and the inside diameter of the tubing string; means for securing the well tool at a desired location within the tubing string; a piston slidably disposed within the longitudinal bore; and means for sealing between the longitudinal bore and the piston whereby movement of the piston longitudinally with respect to the housing blocks fluid communication through the longitudinal bore.

One object of the present invention is to provide a well tool or bridge plug which can block fluid flow through one leg of an H-member.

Another object of the present invention is to provide a bridge plug which can be secured within a portion of tubing filled with liquid without having to displace any liquid from the tubing.

Still another object of the present invention is to provide a bridge plug which can be secured within one leg of an H-member, even though the H-member and tubing extending there below is filled with a constant volume of liquid.

A further object of the present invention is to provide a compensating bridge plug for use in an H-member with a standing valve installed in the tubing extending below the H-member.

Still other objects and advantages of the present invention will be apparent to those skilled in the art after studying the drawings, written description and claims.

WRITTEN DESCRIPTION OF THE PREFERRED EMBODIMENT

Figure 1C:
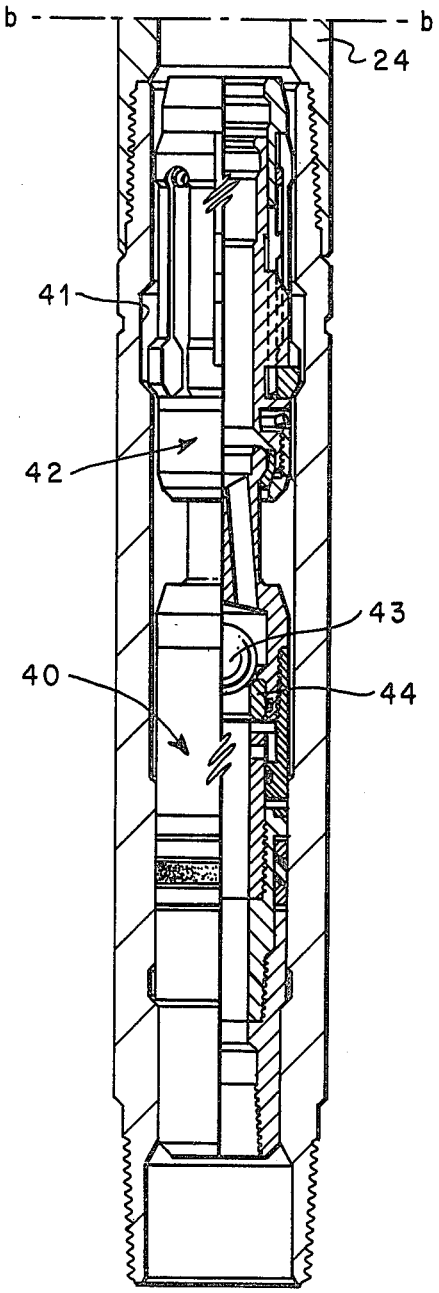
FIG. 1C is a drawing, partially in section and elevation, showing a tubing string extending from the one leg of the H-member. A standing valve is disposed within the lower portion of the tubing string.
Figure 1A:
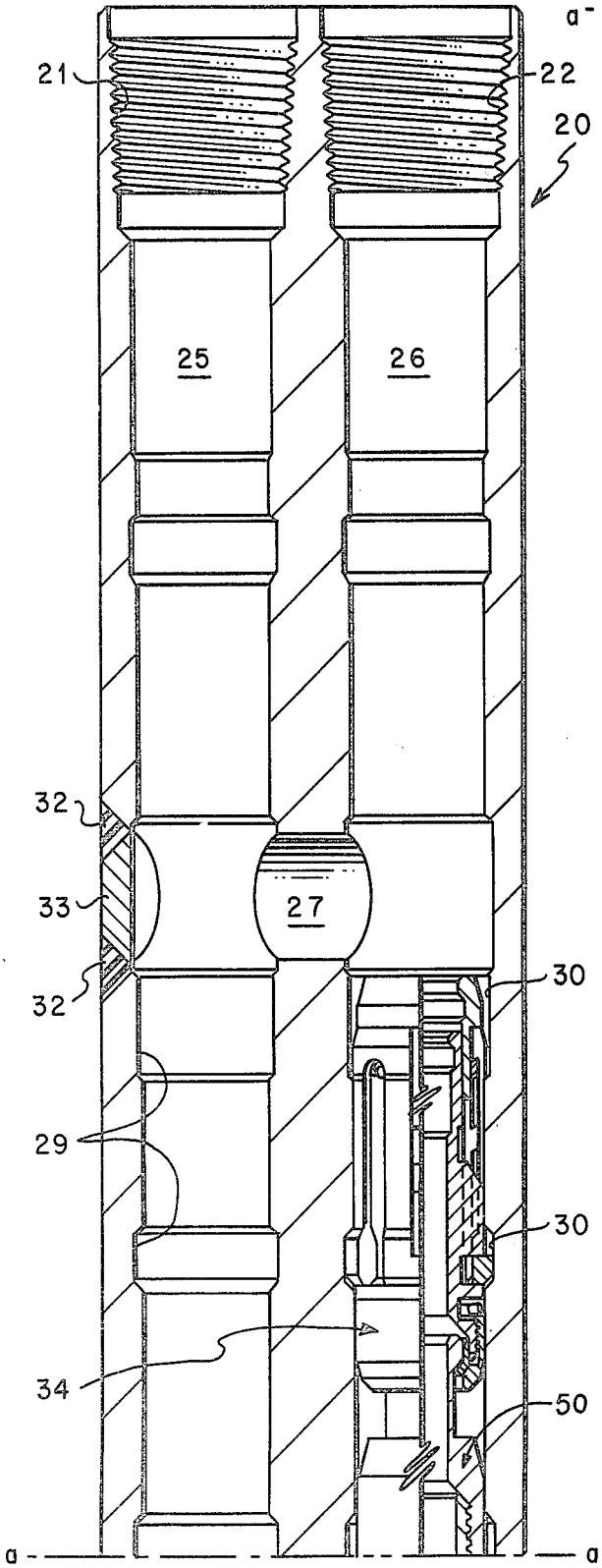
FIGS. 1A and 1B are drawings, partially in section and elevation, showing the bridge plug of the present invention installed within one leg of an H-member.
Figure 1B:
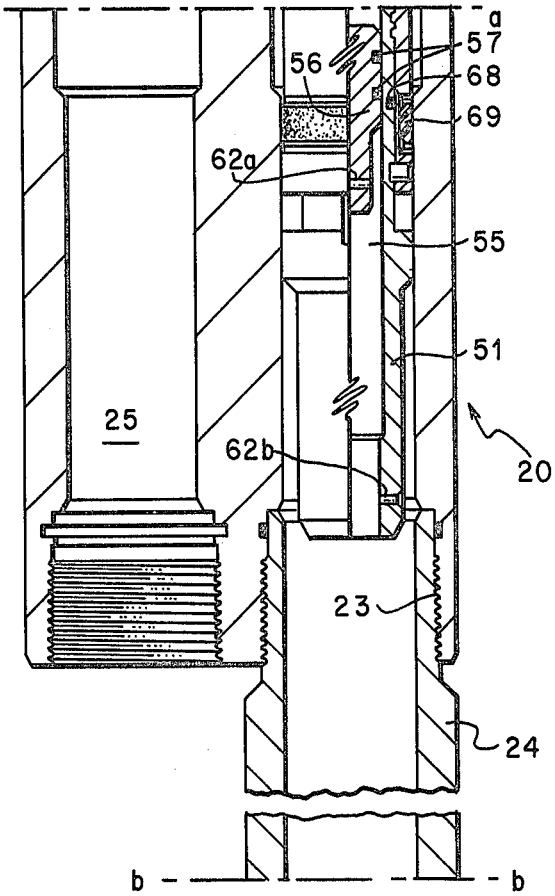
Figure 3:
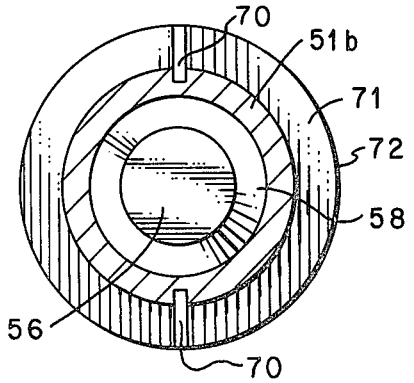
FIG. 3 is a cross sectional view along line 3—3 of FIG. 2 showing the emergency fluid bypass grooves.

Referring to the drawings and particularly FIGS. 1A and 1B, an H-member or cross-over assembly 20 is shown. U.S. Pat. No. 3,664,427 to Thomas M. Deaton and U.S. Pat. No. 3,739,850 to Phillip S. Sizer disclose H-members satisfactory for use with the present invention. Both patents are incorporated by reference for all purposes.

H-member 20 is normally positioned within a well bore (not shown) with two separate production tubing strings (not shown) connected at threads 21 and 22. Tubing strings connected at threads 21 and 22 would communicate fluids with the well surface. Production tubing strings would normally extend from below H-member 20 to the vicinity of a hydrocarbon producing formation (not shown). One such tubing string 24 is shown attached to threads 23 on the lower end of H-member 20. Two longitudinal bores or legs 25 and 26 extend through H-member 20 and communicate fluids with tubing strings attached respectively to each end of each longitudinal bore or leg. A lateral bore 27 is contained within H-member 20 and communicates fluid between longitudinal bores 25 and 26. Lateral bore 27 completes the fluid flow path allowing TFL tools to be moved through production tubing by fluid flow. Lateral bore 27 is sometimes referred to as the circulation point indicating that fluid can communicate from one tubing string to the other at this location. Generally, TFL tools are not moved below the circulation point.

Recesses or landing profiles 30 and 29 are formed within bores 26 and 25 respectively below lateral bore 27. For ease of manufacture, lateral bore 27 is formed by drilling through one wall of H-member 20 and then sealing the opening with welds 32 and closure 33.

During some well operations, such as injecting acid into a hydrocarbon formation, it may be desirable to isolate one tubing string from the other below the circulation point. Recesses 29 and 30 provide means for engaging a locking mandrel such as 34 within either longitudinal bore 25 or 26. A conventional bridge plug could be attached to the lower end of locking mandrel 34 to block fluid communication through the selected longitudinal bore.

Since pressurized fluid is used to move the tool string through the tubing in TFL completions, standing valves or one way check valves are installed in the lower end of each production tubing string below the H-member. The standing valve allows formation fluids to flow into the tubing string but prevents pressured fluid used to move the TFL tools from being applied to the hydrocarbon producing formation. FIG. 1C shows a conventional standing valve 40 secured within the lower end of tubing 24. Locking mandrel 42, similar to mandrel 34, engages profile 41 to releasably secure valve 40 in place. Ball check means 43 allows flow into the bore of tubing 24 and engages seat 44 to prevent fluid flow out of the lower end of tubing 24.

Prior to the present invention, standing valve 40 would have to be removed from tubing 24 before installing a bridge plug within bore 26. Otherwise, liquid would be trapped between the bridge plug and valve 40, forming a hydraulic lock preventing locking mandrel 34 from properly engaging profile 30. Removal of standing valve 40 may be undesirable if fluids hazardous to the hydrocarbon formation communicating with tubing 24 are contained within tubing 24 between lateral bore 27 and standing valve 40.

Figure 2:
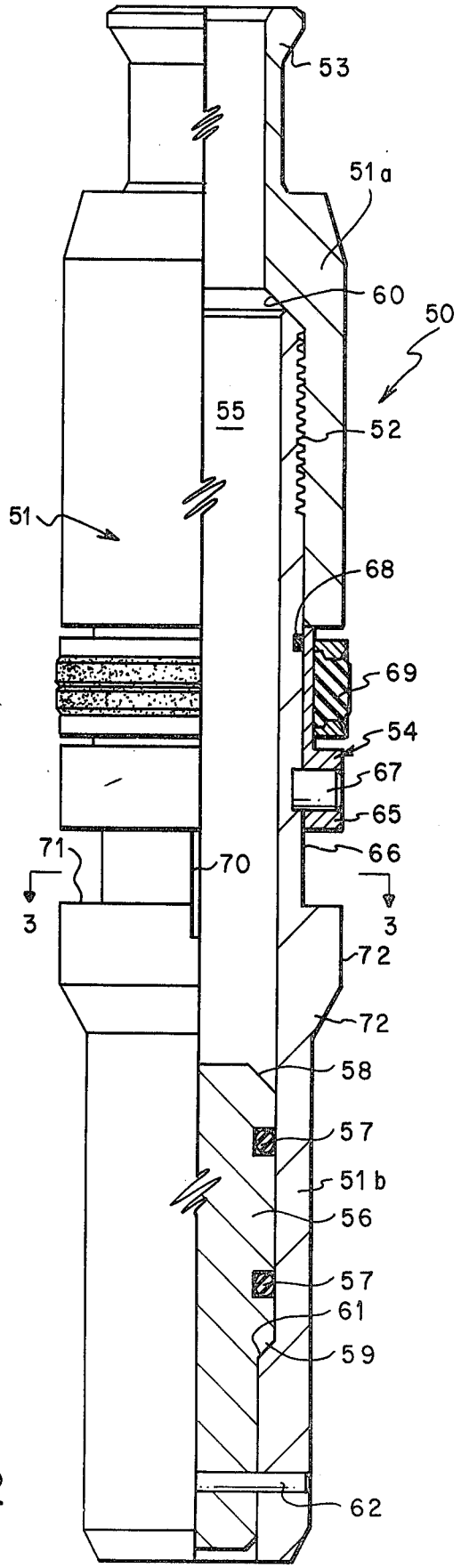
FIG. 2 is a drawing, partially in section and elevation, showing the bridge plug of the present invention prior to installation in a well.

The present invention, shown in FIG. 2 comprises a bridge plug which compensates for any liquid trapped within tubing 24. Compensating bridge plug 50 can be installed within longitudinal bore 26 below lateral bore 27 without having to displace any liquid from tubing 24.

For ease of manufacture, bridge plug 50 comprises housing 51 formed from two subassemblies 51*a* and 51*b* joined at threads 52. Housing subassembly 51*a* has a swivel connection 53 engageable by locking mandrel 34. Housing subassembly 51*b* carries seal assembly 54 on its outside diameter. Longitudinal bore 55 extends through housing 51 with piston means 56 disposed therein. O-rings 57 are carried on the outside diameter of piston means 56 to form a fluid tight seal with the inside diameter of bore 55. Shoulders 58 and 59 are formed on the outside diameter of piston means 56 and are engageable respectively with shoulders 60 and 61 formed on the inside diameter of bore 55. When housing subassemblies 51*a* and 51*b* are engaged at threads 52, piston means 56 is slidably retained within bore 55 and prevents fluid flow through bore 55. Shear pin 62 releasably secures piston means 56 within one end of bore 55.

Seal assembly 54 provides a means for forming a fluid tight seal between the outside diameter of housing 51 and the inside diameter longitudinal bore 26. Seal assembly 54 comprises a carrier cylinder or sleeve 65 slidably disposed on the exterior of reduced diameter portion 66. Shear pin 67 holds carrier 65 in its normal position with respect to housing 51. O-ring 68 carried on the exterior of reduced diameter portion 66 forms a fluid tight seal between the outside diameter of housing 51 and the inside diameter of carrier 65 when carrier 65 is in its normal position. Packing element 69, on the exterior of carrier 65, forms a fluid tight seal between the inside diameter of bore 26 and the outside diameter of carrier 65. When bridge plug 50 is installed within bore 26, o-rings 57 and 68 and packing element 69 cooperate to prevent fluid communication through the production tubing connected to either end of bore 26.

Longitudinal grooves 70 are formed on the outside diameter of housing 51, spaced longitudinally from o-ring 68. If pin 67 is sheared, carrier 65 can slide on reduced diameter portion 66. Shoulder 71, formed by enlarged diameter portion 72 of housing subassembly 51*b*, limits the travel of carrier 65. Movement of carrier 65 releases the fluid tight seal formed with o-ring 68. When carrier or sleeve 65 engages shoulder 71, grooves 70 provide an equalizing flow passage around packing element 69. Shear pin 67, carrier 65 and grooves 70 cooperate to provide a means for equalizing pressure across packing element 69 under emergency conditions.

OPERATING SEQUENCE

Bridge plug 50 as shown in FIG. 2 is engaged by swivel connection 53 at the well surface (not shown) with locking mandrel 34. Prior art bridge plugs would require the removal of standing valve 40 before bridge plug 50 could be secured within bore 26. The present invention allows bridge plug 50 to be installed with standing valve 40 in place and tubing 24 filled with liquid from lateral bore 27 to standing valve 40.

Bridge plug 50 and locking mandrel 34 are connected to a TFL or pumpdown tool string (not shown) and inserted through tubing connected from the well surface to bore 26. During movement of the tool string, fluid below the tool string circulates through lateral bore 27 and returns to the well surface through tubing connected to bore 25.

When seals 57 and 68 and packing element 69 have moved past lateral bore 27, a hydraulic block temporarily develops between ball check 43 and the above seals. Liquid trapped in this region is incompressible and prevents locking mandrel 34 from fully engaging profile 30. As more force is applied to locking mandrel 34, the pressure in tubing 24 will increase until pin 62 shears. Piston means 56 can then slide relative to housing 51 compensating for the volume of fluid trapped within tubing 24 and allowing locking mandrel 34 to engage profile 30.

Since profile 30 is located below lateral bore 27, fluid can be circulated from the well surface through longitudinal bore 25 to remove the TFL tool string leaving bridge plug 50 and locking mandrel 34 installed as shown in FIGS. 1A and 1B. Piston means 56 is shown in FIG. 1B moved relative to housing 51 to compensate for liquid trapped in tubing 24.

Locking mandrel 34 with bridge plug 50 attached can be removed from bore 26 by conventional pumpdown techniques. A TFL tool string is pumped down through tubing attached to bore 26 and engages mandrel 34. During this pumpdown evolution, the fluid pressure above packing element 69 may be greater than the fluid pressure in tubing 24 below bridge plug 50. This pressure difference tends to hold bridge plug 50 in place preventing removal of locking mandrel 34 from profile 30. The fluid pressure above packing element 69 can be increased until pin 67 shears. Carrier 65 can then slide over reduced diameter portion 66 until carrier 65 contacts shoulder 71. This movement of carrier 65 breaks the fluid tight seal with o-ring 68 and allows the fluid pressure above and below the bridge plug 50 to equalize through grooves 70. The TFL tool string can then remove bridge plug 50 from bore 26.

The present invention can be used at any location within a tubing string which has locking recesses similar to profile 30 and a smooth inside diameter to engage packing element 69. The previous description is illustrative of only some of the embodiments of the present invention. Those skilled in the art will readily see other variations for a well tool using the present invention. Changes and modifications may be made without departing from the scope of the present invention which is defined by the claims.

What is claimed is:

1. A well tool for blocking fluid communication through a tubing string, comprising:

a. a housing with a longitudinal bore therethrough;

b. means, carried on the exterior of the housing, for forming a fluid tight seal between the exterior of the housing and the inside diameter of the tubing string;

c. means for securing the well tool at a desired location within the tubing string;

d. piston means slidably disposed within the longitudinal bore;

e. means for sealing between the longitudinal bore and the piston to block fluid communication through the longitudinal bore;

f. the sealing means maintaining contact between the piston means and the longitudinal bore throughout movement of the piston means relative to the longitudinal bore to block fluid flow through the longitudinal bore; and g. the sealing means and means, carried on the exterior of the housing, for forming a fluid tight seal cooperating to block fluid communication through the tubing string.

2. A well tool as defined in claim 1, further comprising:

a. means for releasably securing the piston means with the longitudinal bore; and b. means for limiting the movement of the piston with respect to the housing whereby the piston means is confined within the longitudinal bore.

3. A well tool as defined in claim 2, wherein the means for securing the well tool comprises an external fish neck adapted for engagement with a pumpdown locking mandrel.

4. A well tool as defined in claim 1, further comprising means for equalizing any pressure differential across the exterior sealing means.

5. A compensating plug for forming a fluid tight seal within one portion of a cross-over assembly to prevent fluid communication between other portions of the cross-over assembly and a tubing string attached to the one portion, comprising:

a. a housing with a longitudinal bore therethrough;

b. means, carried on the exterior of the housing, for forming a fluid tight seal between the exterior of the housing and the inside diameter of the one portion of the cross-over assembly;

c. means for securing the compensating plug at a desired location within the cross-over assembly;

d. a piston slidably disposed with the longitudinal bore;

e. means for sealing between the longitudinal bore and the piston during movement of the piston longitudinally with respect to the housing to block fluid communication through the longitudinal bore; and f. the sealing means and means, carried on the exterior of the housing, for forming a fluid tight seal cooperating to prevent fluid communication between other portions of the cross-over assembly without regard to the position of the piston within the longitudinal bore.

6. A compensating plug as defined in claim 5, further comprising:

a. a longitudinal groove formed on the exterior of the housing;

b. the exterior sealing means comprising a sleeve slidably disposed on the housing and elastomeric sealing material fixed to the sleeve;

c. means for releasably holding the sleeve relative to the groove; and d. second seal means forming a fluid tight seal between the housing and the inside diameter of the sleeve when the releasable holding means is engaged.

7. A compensating plug for forming a fluid tight seal within one portion of a cross-over assembly to prevent fluid communication between other portions of the cross-over assembly and a tubing string attached to the one portion, comprising:

a. a housing with a longitudinal bore therethrough;

b. means, carried on the exterior of the housing, for forming a fluid tight seal between the exterior of the housing and the inside diameter of the one portion of the cross-over assembly;

c. means for securing the compensating plug at a desired location within the cross-over assembly;

d. a piston slidably disposed with the longitudinal bore;

e. means for sealing between the longitudinal bore and the piston whereby movement of the piston longitudinally with respect to the housing blocks fluid communication through the longitudinal bore;

f. a longitudinal groove formed on the exterior of the housing;

g. the exterior sealing means comprising a sleeve slidably disposed on the housing and elastomeric sealing material fixed to the sleeve;

h. means for releasably holding the sleeve relative to the groove; and i. second seal means forming a fluid tight seal between the housing and the inside diameter of the sleeve when the releasable holding means is engaged.

* * * * *